US008201956B2

(12) United States Patent
Yeh

(10) Patent No.: US 8,201,956 B2
(45) Date of Patent: Jun. 19, 2012

(54) TASK LIGHT

(75) Inventor: Kuo-Tai Yeh, Taipei (TW)

(73) Assignee: 3M Innovative Properties Company, St. Paul, MN (US)

( * ) Notice: Subject to any disclaimer, the term of this patent is extended or adjusted under 35 U.S.C. 154(b) by 98 days.

(21) Appl. No.: 12/770,530

(22) Filed: Apr. 29, 2010

(65) Prior Publication Data

US 2010/0277888 A1 Nov. 4, 2010

Related U.S. Application Data

(60) Provisional application No. 61/174,172, filed on Apr. 30, 2009.

(51) Int. Cl.
*F21V 9/14* (2006.01)

(52) U.S. Cl. .. 362/19; 359/488.01; 362/33; 362/217.03; 362/218; 362/290; 362/354

(58) Field of Classification Search ..... 362/19, 362/33, 217.03, 217.04, 218, 290–292, 330, 362/342, 354, 294, 373; 359/488.01
See application file for complete search history.

(56) References Cited

U.S. PATENT DOCUMENTS

| | | | | |
|---|---|---|---|---|
| 2,423,322 | A * | 7/1947 | Hurley, Jr. | 362/19 |
| 2,591,251 | A | 4/1952 | Gilman | |
| 2,683,799 | A | 7/1954 | Taylor | |
| 2,745,001 | A | 5/1956 | Guth | |
| 3,169,710 | A | 2/1965 | Lipscomb | |
| 4,173,034 | A | 10/1979 | Shemitz | |
| 4,384,318 | A | 5/1983 | Reibling | |
| 6,164,800 | A | 12/2000 | McIlwraith | |
| 2008/0212324 | A1 | 9/2008 | Lin | |
| 2008/0239723 | A1 | 10/2008 | Lin | |
| 2008/0253129 | A1 | 10/2008 | Lin | |
| 2008/0285273 | A1 | 11/2008 | Liu | |

FOREIGN PATENT DOCUMENTS

| | | |
|---|---|---|
| GB | 460666 | 1/1937 |
| GB | 531868 | 1/1941 |
| TW | 185281 | 6/1992 |
| TW | M305871 | 2/2007 |
| TW | M339629 | 9/2008 |
| TW | M339631 | 9/2008 |
| WO | WO 95-17303 | 6/1995 |
| WO | WO 96-19347 | 6/1996 |
| WO | WO 2008-144636 | 11/2008 |
| WO | WO 2008-144656 | 11/2008 |

OTHER PUBLICATIONS

Japuntich, "Polarized Task Lighting to Reduce Reflective Glare in Open-Plan Office Cubicles", Applied Ergonomics, vol. 32, pp. 485-499, (2001).

Search Report of PCTUS2010-033015, 4 pages, date mailed Jul. 21, 2010.

* cited by examiner

*Primary Examiner* — Stephen F Husar
(74) *Attorney, Agent, or Firm* — Robert H. Jordan

(57) ABSTRACT

A task lighting apparatus produces glare-free illumination of a work area. The apparatus includes a shade defining a cavity having an opening, a light source positioned to emit light into the cavity, and a glare control member disposed within the opening wherein the diffuser comprises a louvered array of dual brightness enhancement film.

9 Claims, 3 Drawing Sheets

TASK LIGHT

PRIORITY CLAIM

This application claims priority to U.S. Provisional Patent Application No. 61/174,172, filed Apr. 30, 2009, which is incorporated herein by reference.

FIELD

The present invention relates to task lights, and in particular, to task lights with improved anti-glare and illumination performance.

BACKGROUND

Task lighting is lighting supplementary to general ambient lighting to provide additional illumination of a work area or surface, such as, for example, a desk top, work bench, or a counter top. Work surfaces located under cabinets or shelves will often have much of the ambient lighting, e.g., room lighting, at least partially blocked. Therefore, a task light is necessary to adequately illuminate those surfaces. Also, many times the ambient lighting is insufficient to provide adequate illumination of a work surface, and, therefore, a task light is necessary to supplement the ambient lighting.

Ideally, a task light will perform two major functions: (1) it will increase the overall illumination level on the work surface, and (2) it will produce a glare-free visual environment. In addition, the ideal task light will have other attributes, such as a low profile and high light output without significantly heating the work area.

Many common prior task light designs incorporate one or two fluorescent lamp tubes, e.g., in lengths ranging from 9 inches to 48 inches. The lamp was either exposed or was mounted in an enclosure having a clear lens, a prismed lens or an "egg-crate" baffle. Such task light fixtures are typically mounted under cabinets or shelves or are suspended above the work surface, and extend laterally along most of the length of the work surface. Such fixtures usually provide adequate illumination, but do not adequately address the problem of glare control. When such fixtures are located directly in an angular line with the eye, objectionable reflective glare will be experienced. This is annoying and tiring to the viewer.

There are three types of glare: direct, contrast, and indirect. Direct glare occurs when there are bright light sources directly in the operator's field of view. Windows are often a source of direct glare, or one may experience direct glare by looking straightly to the sun or a light bulb. Contrast glare is where one part of the vision area is much brighter than another. Usually it is caused by large differences in light levels within the visual field. For example, it may happen when there are two light sources illuminating a same general area, such as a study room, in that an area light such as the luminaire fitted on the ceiling is used for lighting the whole study room while a task light such as a desktop lamp is used for specifically lighting a working area on the desk, thereby, large differences in light levels will be caused in the visual field. Indirect glare occurs when light from windows or overhead lighting is reflected off shiny surfaces in the field of view, such as terminal screens, desks and other office equipment, which is considered to be the most commonly experienced glare and is the one that causes most discomfort to human eye.

U.S. Pat. No. 4,384,318 (Reibling) discloses a task lighting apparatus that includes light directing, preferably highly specular, louvers to provide a controlled light pattern of high illumination and high efficiency. U.S. Patent Publn. No. 2008/0253129 (Lin et al.) discloses a lamp fixture comprising a light-control microstructure for controlling the angle of light emission so as to reduce glare.

The need exists for improved task lighting that provides effective bright illumination with reduced glare.

SUMMARY

The present invention provides task lights that provide bright illumination with reduced glare, particularly with reduction to direct glare and indirect glare. In addition, task lights of the invention can operate at cooler temperatures for constant illumination output, with reduced problems arising from high temperatures, e.g., reduced risk of burns from touching the fixture, etc.

In brief summary, task lights of the invention comprise a shade defining a cavity having an opening, a light source positioned to emit light into the cavity, and a glare control member disposed within the opening wherein the glare control member comprises a louvered array of light diffusing members. The light diffusing members are preferably polarizers. Depending upon the configuration of the task light, the light source may emit light into the cavity from within the cavity or the light source may be positioned outside the cavity but in optical connection therewith such that light emitted from the light source is directed into the cavity from whence it will be emitted from the light to provide desired illumination in accordance with the invention.

BRIEF DESCRIPTION OF DRAWING

The invention is further explained with reference to the drawing wherein.

These figures are not to scale and are intended to be merely illustrative and not limiting.

DETAILED DESCRIPTION OF ILLUSTRATIVE EMBODIMENTS

Figure 1:
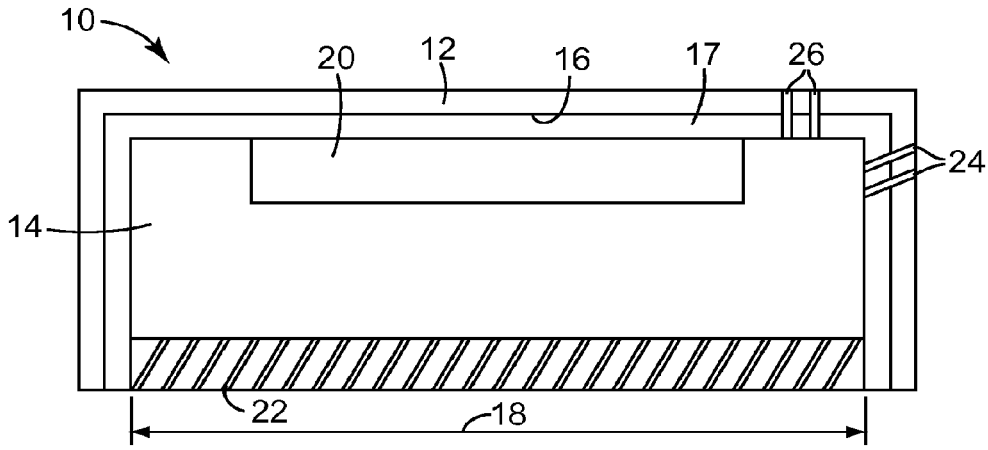
FIG. 1 is a cross sectional view of an illustrative embodiment of a task light of the invention.

Referring to FIG. 1 wherein is shown light fixture 10 comprising lamp head or shade 12 which defines lumination cavity 14 having inner surface 16, optional reflector 17, and opening 18. Light source 20 is disposed inside cavity 14. Fixture 10 further comprises, disposed within opening 18, glare control member 22. The task light will typically include a power source for the light source (e.g., wiring for electricity such as from battery or power grid such as wall outlets, not shown) and control mechanism (e.g., a switch, also not shown).

In accordance with the invention, glare control member 22 is a louvered array of light diffusing members. In a preferred embodiment, the members are light transmissive slats with polarizers such as dual brightness enhancement film thereon. For instance, the slats may comprise 3M™ VIKUITY™ Dual Brightness Enhancement Film. Details concerning this commercially available product can be found in PCT publications WO95/17303 and WO96/19347. Such films are transmissive to or will pass p-waves while being reflective or at least relatively non-transmissive to s-waves, thereby reducing the s-waves which would otherwise be emitted by the task light and, as a result reducing glare which would otherwise be generated by the light fixture. Reduction of incident s-wave light in illumination on a work surface, sometimes referred to as "veiling illumination" is known to reduce so-called "veiling glare".

An unpolarized ray of light consists of light waves having transverse vibrations of equal magnitude that oscillate about the line representing the direction of the light ray. For simplicity, it is common to resolve the amplitude of the light ray vibrations into components vibrating in two planes at right angles to each other along this line, the two principal components being the vertically vibrating p-waves and the horizontally vibrating s-waves. In accordance with the present invention, the light diffusing members are preferentially transmissive to p-wave light as compared to s-wave light, i.e., they will transmit a higher portion of the p-wave light incident thereto than the portion of s-wave light which is incident thereto. For example, the members will typically transmit at least 50% of incident p-wave light and less than 50% of incident s-wave light, in some instances at least 75% of incident p-wave light and less than 35% of incident s-wave light, and in some instances at least 85% of incident p-wave light and less than 20% of incident s-wave light.

Figure 2:
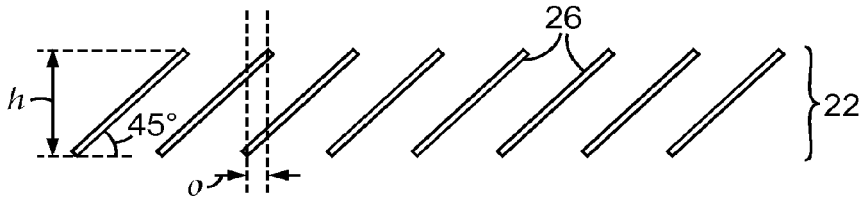
FIG. 2 is a schematic diagram of an illustrative glare control member of the invention.

As shown in FIG. 2, the array is made up of a plurality of members arranged parallel to each other, and in the embodiment shown oriented at a 45° angle to the plane. Embodiments of the invention may be made with orientations typically ranging from about 10° to about 80°, with the range of about 30° to about 60° typically being preferred.

In the direction perpendicular to the planar array, each member or slat preferably overlaps with those adjacent to it. In an illustrative embodiment, the longitudinal overlap, i.e., dimension o, is about 2 millimeters, and the height array, dimension h, is 10 millimeters. The array should be sufficiently wide and long to be fully coextensive with the opening in the shade. The array is substantially open between the slats to permit fresh air to move into the cavity when the lamp is in operation, preferably at least 5 millimeters. The slats should be sufficiently thick to retain their shape and sufficiently thin to permit efficient light transmission. Typically their thickness will be in the range of from about 5 to about 50 millimeters, depending in part upon such factors as the properties of the material(s) used and the configuration and dimensions of the task light.

Figure 3:
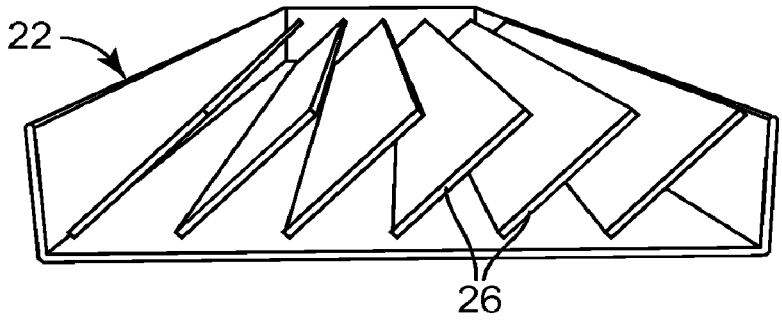
FIGS. 3 and 4 are perspective views of glare control member s of the invention.
Figure 4:
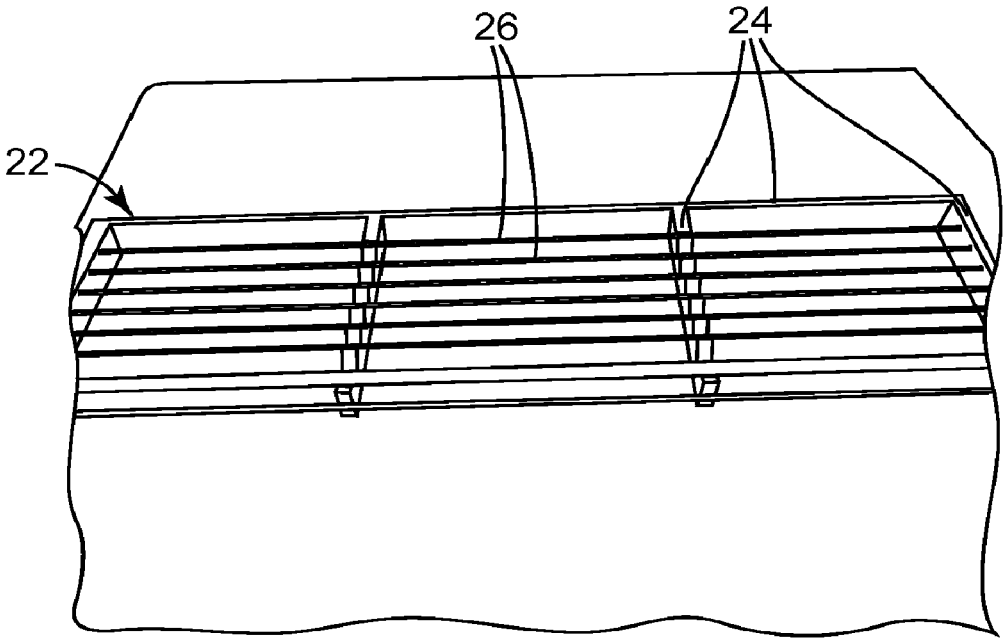

Turning to FIGS. 3 and 4, therein is shown a glare control member 22 made up of an array of frame members 24 and light diffusing slats 26.

The light source can be selected to emit light in desired wave lengths and color spectra. Typically, the light source will be selected from the group consisting of an incandescent bulb, a fluorescent lamp, a light emitting diode, and combination thereof.

Figure 5:
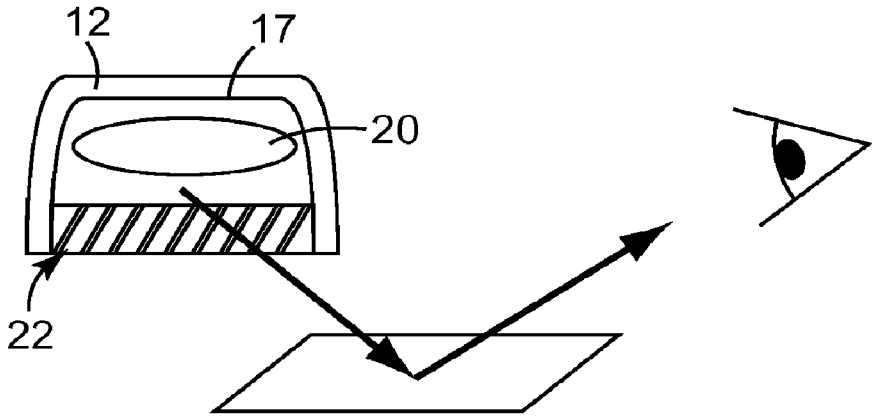
FIGS. 5 and 6 are schematic diagrams illustrating optimum arrangement of task lights of the invention with users so as to achieve effective glare reduction.
Figure 6:
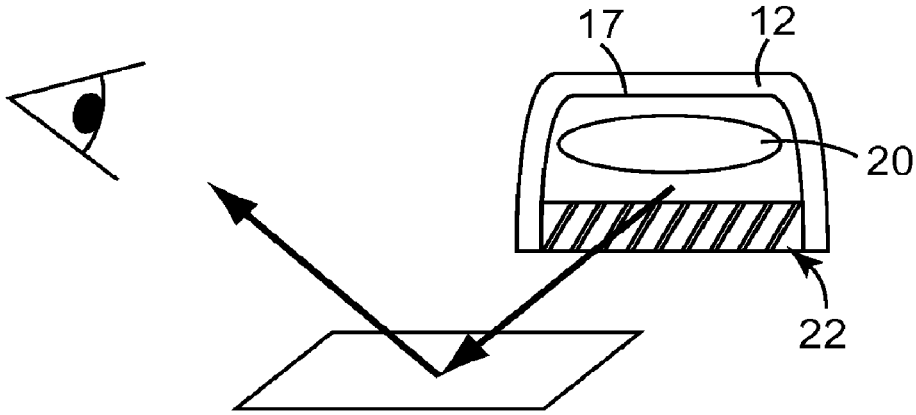

The task light should be positioned relative to the work surface and the viewer such that the array is oriented such that light rays emitted by the light source must pass through at least one of the slats before being incident upon the work surface and reflected on to the viewer. In other words, the path which light passes from the light source, out of the light fixture to be incident to the work surface and from there reflected to the eyes of a user, sometimes referred to as the "optical path" passes through at least one slat of a glare control member as described herein. This arrangement is shown schematically in FIG. 5. In the arrangement shown schematically in FIG. 6, light rays may be incident directly upon the work surface without passing through a slat, thereby generating a high glare condition which is to be avoided.

If desired, the light fixture may further comprise a reflector inside the cavity which increases efficiency of the fixture by reflecting portions of light emitted by the light source toward the opening so that the work area is more brightly illuminated. Some illustrative examples of suitable reflector include metal coated foils, coatings on the inside surface of the cavity, etc.

Depending upon the type of light source used, in some embodiments it will be preferred that the shade have one or more vent openings (e.g., openings 24 in the side(s) and/or openings 26 in the top thereof) to permit air to flow through the openings between the slats in the glare control member, through the cavity, and through the shade. By thus achieving a flow of air through the fixture, heat buildup in the fixture is reduced. As a result, some undesirable effects of heating are reduced, such as the tendency of some fixtures to emit odor while in use, possibility of burning to the touch, etc.

Depending upon the embodiment, lamp head 12 may be mounted on the bottom of a shelf (not shown) or on a wall or other vertical surface so as to orient glare control member 20 toward the work area. In some embodiments, lamp head 12 is part of a desk lamp, e.g., with a base and post capable of standing on a surface oriented so as to illuminate a work area.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A light fixture comprising a shade having a number of vent openings formed therein and defining a cavity having an opening, a light source positioned to emit light into said cavity, and a glare control member disposed within said opening wherein said glare control member comprises a louvered array comprising a plurality of light transmissive, light diffusing members arranged parallel to each other with openings therebetween, defining a plane and oriented such that members overlap with adjacent members in the direction perpendicular to the plane of the array.

2. The fixture of claim 1 further comprising a reflector on the inner surface of said cavity.

3. The fixture of claim 1 wherein said light source is at least a device selected from the group consisting of an incandescent bulb, a fluorescent lamp, a light emitting diode, and a combination thereof.

4. The fixture of claim 1 wherein said light diffusing members comprise light polarizing material.

5. The fixture of claim 4 wherein said light polarizing material tends to pass p-waves and to reflect s-waves.

6. The fixture of claim 5 wherein said light polarizing material transmits at least 50% of p-wave light incident thereto and transmits less than 50% of s-wave light incident thereto.

7. The fixture of claim 5 wherein said light polarizing material transmits at least 75% of p-wave light incident thereto and transmits less than 35% of s-wave light incident thereto.

8. The fixture of claim 5 wherein said light polarizing material transmits at least 85% of p-wave light incident thereto and transmits less than 20% of s-wave light incident thereto.

9. The fixture of claim 1 wherein said members are oriented to said plane at an angle from about 10° to about 80°.

* * * * *